US005309163A

United States Patent [19]

Ngan et al.

[11] Patent Number: 5,309,163

[45] Date of Patent: May 3, 1994

[54] ACTIVE PATCH ANTENNA TRANSMITTER

[75] Inventors: Yiu C. Ngan, San Gabriel; Wayne W. Lam, Torrance; Yoshio Saito, Westchester, all of Calif.

[73] Assignee: TRW Inc., Redondo Beach, Calif.

[21] Appl. No.: 758,135

[22] Filed: Sep. 12, 1991

[51] Int. Cl.[5] ..... H01Q 1/38

[52] U.S. Cl. ..... 343/700 MS; 343/745

[58] Field of Search ..... 343/700 MS, 846, 769, 343/745; 333/246, 247, 248; H01Q 1/38, 13/08

[56] References Cited

U.S. PATENT DOCUMENTS 4,410,891 10/1983 Schaubert et al. ..... 343/700 MS
4,751,513 6/1988 Daryoush et al. ..... 343/700 MS
4,777,490 10/1988 Sharma et al. ..... 343/700 MS
4,780,724 10/1988 Sharma et al. ..... 343/700 MS

OTHER PUBLICATIONS

Buechler et al., IEEE Transactions on Microwave Theory and Techniques, vol. MIT-34, No. 12, Dec. 1986.

*Primary Examiner*—Michael C. Wimer
*Assistant Examiner*—Tan Ho
*Attorney, Agent, or Firm*—Ronald L. Taylor

[57] ABSTRACT

A "packageless" diode chip is integrated into a microstrip patch antenna. Application of DC current to the device results in efficient radiation of high powered microwave frequency signals directly into free space.

15 Claims, 1 Drawing Sheet

ACTIVE PATCH ANTENNA TRANSMITTER

TECHNICAL FIELD

This invention relates generally to microwave devices and, more particularly, to a millimeter wave active patch antenna transmitter.

DISCUSSION

Many applications exist for small antennas used to radiate microwave energy into free space. For example, such antennas are often employed in passive radar systems to detect presence, absence, or location of objects intercepting a radar beam. Similar antennas functioning as transmitters can be used to guide aircraft, satellites, missiles, and submunitions and may be utilized in collision avoidance systems.

However, at higher microwave or millimeter frequencies, generally those from 20–300 GHz, it is very difficult to produce a compact source of radio frequency (RF) power. The most commonly used method of high power generation at these frequencies involves DC biasing one or more microwave diodes in a metal cavity and extracting the output power generated by the diodes through a metal waveguide opening. This method is extremely expensive, though, due to the very labor intensive tuning process involved in output power optimization, as well as the high cost of machining required to produce the necessary dimensional tolerance and surface finish for the metal cavity in which the diodes are held.

Integrating active devices with microstrip patch antennas offers many desirable features and produces low profile, small, and lightweight devices. While an active patch antenna oscillator using a package Gunn diode has been demonstrated, a Gunn diode is a low powered device normally reserved for receiver rather than transmitter applications. IMPATT, or Impact Avalanche Transit Time, diodes in pill packages are suitable for lower frequency operations, but their bulkiness relative to the wavelength at millimeter wave frequencies creates several limitations in terms of RF power generation and performance reproducability when used in a patch antenna configuration.

It is, therefore, an object of the present invention to provide a compact antenna transmitter capable of efficiently generating high powered microwave or millimeter frequency signals. It is further an object of this invention to construct such a device which can be produced in a high volume monolithic implementation.

SUMMARY OF THE INVENTION

The foregoing and other objects have been attained by integrating a "packageless" IMPATT diode chip into a microstrip patch antenna. A "packageless" diode is one without its associated ceramic ring, gold ribbon bond, and metallic supporting heat sink stud as is standard with pill packaged diodes commonly available commercially. By utilizing a "packageless" diode, undesirable parasitics are reduced and the dimension of the active patch antenna of the present invention is in the order of a wavelength, thereby making it a very compact source of RF power.

An antenna transmitter made in accordance with the present invention generally includes a packageless diode chip integrated into a microstrip patch antenna which typically takes the form of a planar rectangular antenna patch spaced apart in parallel relationship with a ground plane by a dielectric sheet. A suitably sized aperture is provided in the antenna patch and dielectric sheet to accommodate the diode chip. A metallic ribbon or wire spans the aperture contacting the diode in the center thereof to electrically couple the diode chip to the antenna patch. When DC current is applied through the patch antenna and metallic ribbon to the packageless diode, the diode converts the DC power into an RF signal which is radiated by the patch antenna directly into free space.

This approach is very efficient since RF power is radiated directly into free space without the use of a waveguide. Frequencies of up to 32 GHz at an output power of 300 mW have been attained. Also, employing photolithographic or other known processes in the construction of the device enables high volume monolithic implementation in which many diodes can be ion-implanted or grown in a silicon or gallium arsenide (GaAs) wafer.

Additional objects, advantages, and features of the present invention will become apparent from the following description and appended claims, taken in conjunction with the accompanying drawings.

DESCRIPTION OF A PREFERRED EMBODIMENT

Figure 1:
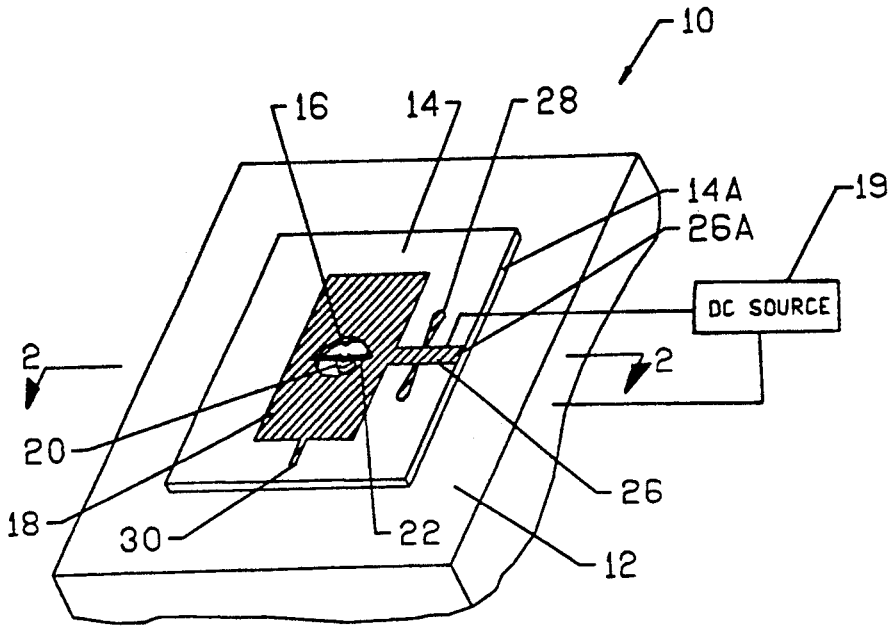
FIG. 1 is a perspective view of the microstrip patch antenna configuration made in accordance with the teachings of the present invention.

Referring now to the drawings, there is shown the active patch antenna transmitter of the present invention 10. A highly conductive ground plane 12, preferably a gold plated copper block, has affixed to one surface thereof a dielectric substrate 14. In a preferred embodiment, dielectric substrate 14 is a sheet of RT Duroid having a dielectric constant of 2.2 and a thickness of 5 mils although it may be another low loss dielectric such as alumina or gallium arsenide. Substrate 14 is bonded to ground plane 12 using gold germanium solder or using another similar process.

An opening or circular aperture 16, preferably of a diameter of approximately 20 mils, is provided in substrate 14 so as to expose a corresponding area of ground plane 12. The position of the circular aperture is near the center of the patch antenna in order to achieve oscillation. A generally rectangular, conductive patch antenna 18 is disposed on the dielectric substrate 14, surrounding aperture 16. Patch antenna 18 may be formed by depositing a metallic or other conductive material on substrate 14 by a photolithographic or other process commonly known by those skilled in the art. For operation at 32 GHz, the patch antenna 18 may have a length of 110 mils (the side perpendicular to DC bias line 26) and a width of 90 mils (the side parallel to DC bias line 26). Disposed within the aperture 16 is a millimeter wave active device, preferably a packageless double-drift silicon IMPATT (Impact Avalanche Transit Time) diode chip 20, positioned such that the diode chip 20 is spaced apart from and not in contact with substrate 14. The packageless IMPATT diode chip is one without its associated pill packaging commonly available commercially and is typically 4 mils in diameter.

Figure 2:
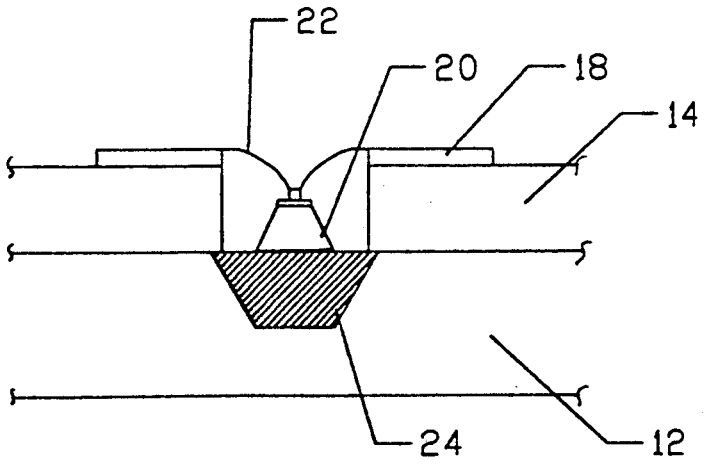
FIG. 2 is a partial cross sectional view taken generally through line 2—2 of FIG. 1.

A gold ribbon 22, or other suitable conductive strip or wire, spans aperture 16 to contact chip 20 substantially in the center of aperture 16. Ribbon 22 is thermo-compression bonded to the diode chip 20 and soldered to patch antenna 18 and serves to cancel diode capacitance as well as increase the output power of the device. A heat sink 24 is provided to absorb the heat dissipated by diode chip 20 and preferably is a metallized type-II diamond which is pressed into the ground plane 12, substantially within aperture 16 as shown in FIG. 2. Heat sink 24 is also thermo-compression bonded to diode chip 20 and provides the ground contact for diode chip 20.

An electrically conductive DC bias line 26 is conductively coupled to patch antenna 18 and extends to an edge 14*a* of substrate 14 for conducting DC power to patch antenna 18 from a DC power source 19. An RF choke 28, having radial stubs on bias line 26 located one quarter wavelength from patch antenna 18, is provided to prevent RF signals from escaping the bias line 26 or being transmitted back to the DC power source. A one quarter wavelength long electrically conductive tuning stub 30 extends perpendicularly from patch antenna 18 for precise tuning of the frequency emitted by antenna 18. This is accomplished by removing small amounts of the stub at the end thereof away from patch 18 as is commonly known in the art. In a preferred embodiment, patch antenna 18, DC bias line 26, RF choke 28, and tuning stub 30 are integrally formed by depositing a metallic or other highly conductive material on substrate 14 by a photolithographic or other process commonly known in the art.

The operation of the device of the present invention will now be described. When DC power from DC power source 19 is applied to the DC bias line 26 at point 26*a*, as shown in FIG. 1, current passes through the patch antenna 18, through gold ribbon 22, and into packageless diode chip 20. Diode chip 20 converts the DC power into RF power which is then radiated by patch antenna 18 directly into free space. RF choke 28 maximizes the radiation of RF power by preventing the transmission of RF signals back toward the DC power source. The heat sink 24 and ground plane 12 provide a DC return path for the device.

This novel antenna transmitter design provides several advantageous features permitting RF signals of 32 GHz at an output power of 300 mW to be generated. By radiating RF power directly into free space, the device of the present invention can be more efficient than other known devices using waveguide means. Utilizing a packageless diode chip 20 reduces undesirable parasitics because packaged diodes have physical dimensions comparable to those of the patch at millimeter wave frequencies. Use of a packageless chip also facilitates a very compact and, therefore, low loss source of RF power, the dimension of the device being in the order of a wavelength. In addition, the design can be readily transitioned to low cost, high volume monolithic implementation in which many diodes are ion-implanted or grown into a silicon or gallium arsenide (GaAs) wafer by processes known in the art, eliminating the need for soldering and bonding.

The foregoing discussion discloses and describes merely exemplary embodiments of the present invention. One skilled in the art will readily recognize from such discussion, and from the accompanying drawings and claims, that various changes, modifications, and variations can be made therein without departing from the spirit and scope of the invention as defined in the following claims.

What is claimed is:

1. A microwave antenna transmitter device comprising:

a conductive ground plane;

a dielectric substrate disposed upon said ground plane, said substrate having an opening formed therein exposing an area of said ground plane;

an electrically conductive antenna patch disposed upon said dielectric substrate so as to surround said substrate opening;

a source of electrical energy; and a packageless IMPATT diode chip electrically coupled to said source of electrical energy for generating microwave frequency energy therefrom, said diode chip conductively coupled to said antenna patch and to said ground plane and said diode chip being disposed upon said ground plane within said opening in said substrate in a spaced relationship with said substrate.

2. The device of claim 1 wherein said antenna patch is conductively coupled to said diode chip by a conductor spanning said substrate opening and conductively contacting said diode chip substantially in the center of said substrate opening.

3. The device of claim 1 further comprising a heat sink disposed between said diode chip and said ground plane to absorb heat dissipated by said diode chip.

4. The device of claim 3 wherein said heat sink comprises a metallized diamond embedded in said ground plane and bonded to said diode chip.

5. The device of claim 1 wherein said antenna patch comprises a metallic film on said substrate.

6. The device of claim 1 further comprising means for selectively tuning the transmitting frequency of said antenna patch.

7. The device of claim 6 wherein said means for tuning comprises an integral tuning stub electrically coupled to said antenna patch.

8. The device of claim 7 wherein said tuning stub comprises a metallic film on said substrate.

9. The device of claim 1 further comprising a DC bias line for electrically coupling said electrical energy source to said antenna patch.

10. The device of claim 9 wherein said DC bias line comprises a metallic film on said substrate.

11. The device of claim 9 wherein said bias line further comprises means for preventing high frequency signals from being conducted from the antenna patch toward the electrical energy source.

12. The device of claim 11 wherein said means for preventing comprises a plurality of radial stubs intersecting said bias line one quarter wavelength from said antenna patch.

13. The device of claim 1 wherein said device radiates RF power directly into free space.

14. The device of claim 1 further comprising means for preventing high frequency signals being conducted from the antenna patch toward said electrical energy source.

15. A millimeter wave antenna transmitter comprising:

a conductive ground plane;

a dielectric substrate disposed on said ground plane, said substrate having an opening formed therein exposing an area of said ground plane within said opening;

an electrically conductive antenna patch disposed upon said dielectric substrate, said antenna patch surrounding said substrate opening;

a packageless millimeter wave impact avalanche transit time (IMPATT) diode chip disposed upon said ground plane within said substrate opening and spaced from said substrate, said diode chip conductively coupled to said antenna patch by a conductor spanning said substrate opening and contacting said diode chip substantially in the center of said substrate opening;

a heat sink disposed between said diode chip and said ground plane to absorb heat dissipated by said diode chip;

an integral tuning stub electrically coupled to said antenna patch;

a DC bias line for electrically coupling a DC power source to said antenna patch; and means for preventing high frequency signals being transmitted from the antenna patch toward the DC power source including a plurality of radial stubs intersecting said bias line one quarter wavelength from said antenna patch, wherein said antenna patch, DC bias line, tuning stub, and means for preventing further comprise a conductive metallic film on said substrate.

* * * * *